United States Patent [19]

Bloore et al.

[11] 4,313,101

[45] Jan. 26, 1982

[54] ELECTRICALLY IMPEDANT ARTICLES

[75] Inventors: Frederick W. Bloore; Peter H. Seaman, both of Wolverhampton, England

[73] Assignee: Hotfoil Limited, Wolverhampton, England

[21] Appl. No.: 40,067

[22] Filed: May 17, 1979

[30] Foreign Application Priority Data

May 18, 1978 [GB] United Kingdom ..... 20418/78

[51] Int. Cl.[3] ..... H01C 3/06; H01C 7/00

[52] U.S. Cl. ..... 338/212; 219/548; 219/549; 338/22 R

[58] Field of Search ..... 338/22 R, 212, 22 SD, 338/214; 252/510, 511; 219/548, 549, 544; 174/120 SC; 264/105

[56] References Cited

U.S. PATENT DOCUMENTS

| | | | |
|---|---|---|---|
| 2,861,163 | 11/1958 | Asakawa | 338/214 |
| 3,096,210 | 7/1963 | Boonstra | 174/120 SC X |
| 3,166,688 | 1/1965 | Rowand et al. | 338/214 X |
| 3,435,401 | 3/1969 | Epstein | 338/214 |
| 3,666,876 | 5/1972 | Forster | 174/120 SC X |
| 3,793,716 | 2/1974 | Smith-Johannsen | 219/548 X |
| 3,858,144 | 12/1974 | Bedard et al. | 219/549 X |
| 3,861,029 | 1/1975 | Smith-Johannsen et al. | 219/544 X |
| 4,020,014 | 4/1977 | Service et al. | 252/511 |
| 4,055,526 | 10/1977 | Kiyokawa et al. | 219/548 X |
| 4,177,376 | 12/1979 | Horsma | 174/DIG. 8 |

*Primary Examiner*—C. L. Albritton

*Attorney, Agent, or Firm*—Pearne, Gordon, Sessions, McCoy & Granger

[57] ABSTRACT

An electrically impedant article comprising an electrode embedded in a polymeric body having dispersed therein electrically conducting carbon black in which the body around the electrode contains a lower percentage of conductive carbon black than do other regions of the body further away from the electrode, the carbon black in said region around the electrode being of higher conductivity than the carbon black in said other regions. The polymeric body preferably comprises a silicone rubber. The article can be a heating tape having a pair of spaced parallel electrodes and may have a positive non-linear temperature co-efficient of impedance.

8 Claims, 1 Drawing Figure

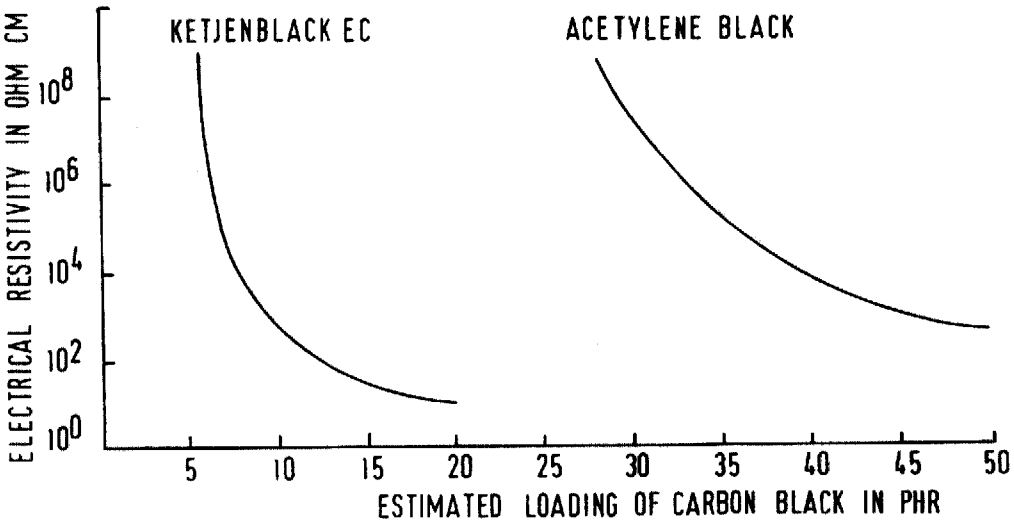
ELECTRICAL RESISTIVITY IN OHM CM
$10^8$
$10^6$
$10^4$
$10^2$
$10^0$
KETJENBLACK EC
ACETYLENE BLACK
5
10
15
20
25
30
35
40
45
50
ESTIMATED LOADING OF CARBON BLACK IN PHR

ELECTRICALLY IMPEDANT ARTICLES

BACKGROUND OF THE INVENTION

Field of the Invention

This invention relates to electrically impedant articles intended to be used as a heating element of the type, hereinafter referred to as the type specified, comprising an electrode embedded in a polymeric body having dispersed therein electrically conductive carbon black. The polymeric body preferably comprises silicone rubber.

SUMMARY OF THE INVENTION

The object of the invention is to provide a new and improved article of the type specified.

According to the invention we provide an article of the type specified wherein the body around the electrode contains a lower percentage of conductive carbon black than does the body in other regions further away from the electrode, the carbon black in said region around the electrode being of higher conductivity than the carbon black in said other regions, the percentage contents being expressed in weight percent based on the weight of polymer content.

The article may be an electrically impedant article having a positive non-linear temperature coefficient of impedance comprising at least one electrode.

The article may be in the form of an elongate tape having a pair of spaced parallel elongate electrodes extending longitudinally of the tape.

The tape may be from 10 to 30 mm in overall width and 1 to 5 mm in overall thickness and of indefinite length.

The tape may be 15 mm wide and 2.4 mm thick.

The body may comprise an electrically conductive silicone rubber comprising up to 25% (based on total material weight) of conductive carbon black in said other regions and from 8 to 18% conductive carbon black in said region around the or each electrode (based on the weight of rubber).

There may be not less than 10% or not more than 20% of carbon black (based on the weight of polymer content) in said other regions.

In said other regions the carbon black may be that produced by the Shawinigan Company whilst in said region around the or each electrode the carbon black may be Ketjenblack EC made by Akzo Chemie Nederland NV Nieuwendammerkade, 1-3 P.O. Box No. 15, Amsterdam-N.

Although the date we have experience only of Ketjenblack EC as a more conductive carbon black for use in the region around the or each electrode it is considered that other carbon blacks may be used so long as they have properties similar to those of Ketjenblack EC. More particularly, Ketjenblack EC has the following physical properties and it is considered that a carbon black having similar physical properties could be used:

$$\frac{\text{Surface Area } (N_2)}{m^2/g} \quad 929 \qquad (1)$$

$$\frac{\textit{DBP}\text{ Absorption}}{ml/100g} \quad 350 \qquad (2)$$

$$\frac{\text{Surface Area } (\textit{CTAB})}{m^2/g} \quad 480 \qquad (3)$$

-continued $$\frac{\text{Particle Diameter}}{nm} \quad 30 \qquad (4)$$

$$\frac{\text{Surface Area } (\textit{EM})}{m^2/g} \quad 108 \qquad (5)$$

$$\frac{\text{Pore Area}}{[\text{values } (1) - (3)]} \quad 449 \qquad (6)$$

Where:

Surface Area (N2) and,

Surface Area (CTAB) are values of surface area determined by absorption of nitrogen and cetyltrimethylammonium bromide, the latter by the technique described by J. Janzen and G. Kraus in Rubber Chem.Technol 44 1287 (1971)

DBP Absorption is a measure of the volume of dibtylphtalate molecules absorbed

Surface Area (EM) is the surface area achieved by electron microscopy

Pore Area

[Values (1)-(3)] is difference in surface area as determined by $N_2$ and CTAB absorption.

Furthermore examination of Ketjenblack EC under the electron microscope indicates that the particles are of hollow shell like configuration and this structure is the cause of the high volume per unit weight of the particles and the high DBP Absorption.

The relationship between morphology of carbon black particles and electrical conductivity in rubbers depend on the fact that current conduction in such charged elastomers is dominated by a tunnel effect in which inter-particle and inter-aggregate distances are of critical importance. Thus it is found that at equal weight loading the conductivity of carbon black loaded polymers is governed by both particle density an aggregate structure. Consequently Ketjenblack EC with an extremely low particle density, shows the minimum resistivity at a considerable lower degree of loading than other blacks such as that produced by Shawinigan Company.

The single FIGURE of the drawing is a graph of electrical resistivity in Ohm cm plotted against carbon black loading in Phr for Ketjenblack EC and acetylene black. Again, any black having similar electrical resistivity to Ketjenblack EC as shown in FIG. 1 may be utilised in the present invention.

When the body comprises silicone rubber it may contain at least one additive the or each additive having a particle size between 0.005 microns and 100 microns, the or each additive being compatible with the rubber, and having a melting point above the curing temperature of the rubber.

There may be from 30% to 200% (based on the weight of silicone gum) of at least one additive.

The additive particle size may be between 0.01 microns and 10 microns.

The additions may be non-electrically conductive and may have a melting point above 400° C.

Surprisingly we have found that the conductivity of the material is maintained even when it contains 200% of additives (based on the weight of silicone gum). The material also has a better life time than silicone rubber containing no additives and we have found that the temperature of the heating element may be maintained constant irrespective of the voltage applied, depending on the operating temperature.

The more highly conductive region around the or each electrode and with which the or each electrode is in contact may comprise a rubber such as ICI silicone rubber E315/50 or CS104 containing 12½% by weight of Ketjenblack EC based on the weight of rubber, and 4% Dicup based on the weight of rubber and optionally 3% Dow Silastic 2437 internal bonding additive extruded as a thin film to cover the electrodes. The thus covered electrodes are then utilised in a further extrusion operation in which the rubber of the main body i.e. said other regions, of the tape is extruded thereon.

The silicone rubber of said other regions may be ICI 315/50 in which case 18.5% (based on the weight of rubber) of Shawinigan carbon black and 4% Dicup 40C (based on the weight of rubber) made by Hercules Powder Company of Wilmington, Delaware, U.S.A. can be provided, ICI 315/50 rubber contains, as supplied by ICI, more than 25% of fumed silica additive and the percentage contents referred to above are in ralation to the weight of the rubber, including additive, as supplied.

A mixture of rubbers may be used, the precise proportion of the rubbers being adjusted so that the final material has a desired conductivity by taking samples and adding more of one of the rubbers to adjust the conductivity.

The additives must be what is known to those skilled in the art as "compatible" with silicone rubber and any compatible material having a melting point above the curing temperature of the rubber, a particle size between 0.005 microns and 100 microns may be used. By compatible we mean, inter alia, that the uncured silicone rubber must wet the additive particles; the cohesive energy between the rubber and the particles must be greater than that between particles and the particles must not affect the curing of the rubber.

We have found the addition of powdered metals surprisingly reduces the conductivity of the rubber by a significant extent. For example in the case of an addition of 100% (based on the weight of silicone gum) of atomised copper or aluminum powder to a conducting silicone rubber such as ICI 315/50 with 20% (based on the weight of rubber) Shawinigan carbon black reduces the conductivity of the resultant mixture by a factor of between 5 to 10 times.

The element may be post cured by heating in an oven for 2 to 12, preferably 2 hours, at 100° to 250° C., preferably 150° C., and then increasing the temperature to 100° to 250° C., preferably 250° C., for a further 2 to 8 hours, preferably 2 hours. In the case of a heating tape an outer sheath of non-conducting silicone rubber (or other material such as a thermosetting or thermoplastic material) is then applied to the tape and the thus sheathed tape is heated to 150° to 350° C. preferably 300° C., for 3 to 5 minutes preferably 3 minutes to cure the outer sheath. Subsequently the outer sheath is post cured by heating the sheathed tape in an oven for 1 to 8 hours, preferably 2 hours, at 100° to 200° C., preferably 150° C., and then increasing the temperature to 150° to 250° C., preferably 250° C., for a further 1 to 8 hours, preferably 2 hours. The tape is then allowed to stand for at least about 1 week. The above procedures whilst not essential are preferable as they increase the conductivity of the material.

Whilst the above is the preferred annealing procedure in the case of a heating tape if desired other procedures may be adopted.

The amount of annealing required varies with the additives, the more additives present the more annealing being required. The annealing operation increases the conductivity compared with that which would be achieved without annealing. If desired for example, when the material is used as a heating tape the material may be permitted to self anneal, with the current on.

DESCRIPTION OF THE PREFERRED EMBODIMENT

In one example a heating tape is 15 mm wide and 2.4 mm thick and is of indefinite length and comprises a pair of spaced parallel wire electrodes. The wires were then covered with a thin film of highly conductive silicone rubber by means of a conventional extrusion operation. The highly conductive rubber of the thin film which was 0.15 mm thick, comprised ICI silicone rubber E315/50 containing from 8 to 12½%, in this example 12½%, by weight of Ketjenblack EC (based on the weight of rubber) and 4% Dicup 40C (based on the weight of rubber) together with 3% Dow Silastic 2437 internal bonding additive to improved adhesion.

The thus coated wires were then embedded in conducting silicone rubber to form the main body of the tape in a conventional extrusion operation. The rubber of the main body of the tape comprised ICI E315/50 rubber containing 20% of Shawinigan carbon black (based on the weight of rubber) and 4% Dicup 40C (based on the weight of rubber) made by Hercules Powder Company.

The heating tape was then post cured by heating in an oven for 2 hours at 150° C. and then increasing the temperature to 250° C. for a further 2 hours.

An outer sheath of ICI 315/50 silicone rubber including appropriate additives and catalyst was applied to the tape in a conventional extrusion operation and the tape was heated to 300° C. for 3 minutes to cure the outer sheath. Subsequently the outer sheath was post cured by heating the sheathed tape in an oven for 2 hours at 150° C. and then increasing the temperature to 250° C. for a further 2 hours.

The tape was allowed to stand for 1 week before being used.

It will be noted that the percentage by weight of carbon black in the higher conductivity region around the electrodes is less than that in the main body of the tape, the higher conductivity of the rubber in the region around the electrodes being achieved due to the properties of the Ketjenblack EC.

The rubber of the main body of the tape could alternatively comprise Dow Corning Ltd. rubbers Q41602 and X41638 in the ratio of 50/50, 40% catalyst B (based on the weight of rubber). Q41602 as supplied by Dow Corning Ltd. contains Shawinigan carbon black. It is believed that it contains about 40% by weight of the carbon black and as we add 50% of X41638, which contains no carbon black, thus we believe the carbon content of the rubber in this case would be 20% (based on the weight of rubber). This rubber may also contain 100% British Titan products RTC-2 titanium dioxide additive (based on the weight of rubber) having a particle size lying in the range 0.1 to 5 microns.

Although a tape having two electrodes has been described hereinbefore the element may comprise a tape or sheet having only one electrode, the current path being provided by placing the article on a conducting support. Or the element may include more than two electrodes, for example, three electrodes if it is a tape to be used with a three phase supply. Alternatively the element may be in the form of a sheet or mat and having a large number of electrodes.

In the specification when "weight of rubber" is referred to we mean the total weight of the rubber material specified and if the rubber material specified includes additives we mean the total weight of the rubber i.e. the weight of the pure gum plus the additives. When "weight of polymer or silicone gum" is to, we mean the weight of the polymer or pure gum component of the material excluding any additives if additives are present in the material referred to.

The thickness of the more highly conductive layer is determined mainly by practical considerations; the lower limit is the need to achieve complete coverage of the electrode and the upper limit is that imposed upon the tape thickness by market considerations. Typically the layer thickness will lie in the range 0.1–0.3 mm.

We claim:

1. An electrically impedant article comprising an electrode embedded in a polymeric body having dispersed therein electrically conductive carbon black wherein the body region around the electrode is of higher electrical conductivity than the remainder of the body and contains a lower percantage of electrically conductive carbon black than does the body in other regions further away from the electrode, the carbon black in said region around the electrode being of higher conductivity than the carbon black in said other regions, the percentage contents being expressed in weight percent based on the weight of polymer content.

2. An article according to claim 1 wherein the article is an electrically impedant article having a positive non-linear temperature coefficient of impedance and the polymeric body comprises a silicone rubber.

3. An article according to claim 2 wherein the article is in the form of an elongate tape having a pair of spaced parallel elongate electrodes extending longitudinally of the tape.

4. An article according to claim 3 wherein the tape is from 10 to 30 mm in overall width and from 1 to 5 mm in overall thickness and of indefinite length.

5. An article according to claim 1 wherein the body comprises an electrically conductive silicone rubber comprising up to 25% (based on total material weight) of conductive carbon black in said other regions and from 8 to 18% conductive carbon black in said region around the or each electrode (based on the weight of rubber).

6. An article according to claim 1 wherein the carbon black in said region around the or each electrode comprises particles of hollow shell like configuration.

7. An article according to claim 1 wherein the carbon black in said region around the or each electrode has the following properties:

$$\frac{\text{Surface Area } (N_2)}{m^2/g} = 929 \quad (1)$$

$$\frac{DBP \text{ Absorption}}{ml/100g} = 350 \quad (2)$$

$$\frac{\text{Surface Area } (CTAB)}{m^2/g} = 480 \quad (3)$$

$$\frac{\text{Particle Diameter}}{nm} = 30 \quad (4)$$

$$\frac{\text{Surface Area } (EM)}{m^2/g} = 108 \quad (5)$$

$$\frac{\text{Pore Area}}{[\text{Values } (1) - (3)]} = 449 \quad (6)$$

8. An article according to any one of the preceding claims wherein the body comprises silicone rubber and contains at least one additive having a particle size between 0.005 microns and 100 microns, said additive being compatible with the rubber, and having a melting point above the curing temperature of the rubber.

* * * * *